United States Patent [19]

Freyberg et al.

[11] 4,076,497

[45] Feb. 28, 1978

[54] CONTINUOUS DYEING OF POLYESTER FIBERS AND CELLULOSE FIBERS

[75] Inventors: Peter Freyberg, Speyer; Dieter Horn, Heidelberg; Knut Oppenlaender; Hans Wolf, both of Ludwigshafen; Dieter Distler, Mutterstadt, all of Germany

[73] Assignee: BASF Aktiengesellschaft, Ludwigshafen, Germany

[21] Appl. No.: 651,431

[22] Filed: Jan. 22, 1976

[30] Foreign Application Priority Data

Feb. 1, 1975 Germany ..... 2504282

[51] Int. Cl.[2] ..... D06P 3/82; C09B 67/00

[52] U.S. Cl. ..... 8/21 C; 8/27; 8/37; 8/54.2; 8/88; 8/93; 8/172 R; 8/179

[58] Field of Search ..... 8/169, 88, 93, 27, 21 C, 8/54.2, 172 R, 179

[56] References Cited

U.S. PATENT DOCUMENTS

| | | | |
|---|---|---|---|
| 2,674,619 | 4/1954 | Lundsted | 260/485 |
| 3,223,471 | 12/1965 | Kuth et al. | 8/88 |
| 3,503,698 | 3/1970 | Zurbuchen et al. | 8/41 |
| 3,606,988 | 9/1971 | Walz et al. | 8/54 |
| 3,802,905 | 4/1974 | Beyer et al. | 117/38 |
| 3,822,113 | 7/1974 | Keenan et al. | 8/169 |
| 3,960,486 | 1/1976 | Daubach et al. | 8/79 |

*Primary Examiner*—A. Lionel Clingman

*Attorney, Agent, or Firm*—Keil, Thompson & Shurtleff

[57] ABSTRACT

Polyester fibers and cellulose fibers, and blends of these fibers, are dyed continuously with disperse dyes, or dispersed dyes, by continuous application of an aqueous dye liquor which contains, as the essential dyeing assistant, a polyoxyalkylated amine, a polyoxyalkylated amine-oxide and/or a quaternized polyoxyalkylated amine which in 1% strength aqueous solution has a cloud point of not less than 18° C and which is derived from amines which contain at least 2 nitrogen atoms and at least one group which can be oxyalkylated, followed by drying and fixing.

7 Claims, No Drawings

CONTINUOUS DYEING OF POLYESTER FIBERS AND CELLULOSE FIBERS

The present invention relates to a process for the continuous dyeing of polyester fibers and cellulose fibers, and blends of these fibers, with dispersed dyes and/or disperse dyes by applying an aqueous dye liquor, which contains a dyeing assistant, to the fibers, drying and fixing the dyes.

Continuous dyeing of polyester fibers with disperse dyes and of cellulose fibers with vat dyes is known. In these processes, a dye liquor is applied, eg. by means of a padder, to the fabric, which is then dried and subsequently subjected to further treatment to fix the dyes. During the intermediate drying of the fabric, the dye migrates to the surface or wherever evaporation is taking place, so that uneveness results. A conventional method of obtaining level dyeings is to add to the dye liquor antimigration agents, eg. alginates, carboxymethylcelluloses, polyacrylamides and copolymers containing acrylic acid units. The conventional antimigration agents are not sufficiently effective as assistants, in continuous dyeing of polyester fibers and cellulose fibers and their blends, to give dyeings which conform to the highest standards. Texturized polyester material is particularly difficult to dye evenly by a continuous process. Some conventional antimigration agents destabilize the liquor, even at room temperature, whilst others increase the viscosity and tend to deposit on the applicator rolls.

It is an object of the present invention to provide an antimigration agent, for the process described above, which is more effective than the conventional antimigration agents.

We have found that this object is achieved, according to the invention, by using, as dyeing assistants, polyoxyalkylated amines, amine-oxides of polyoxyalkylated amines and/or quaternized polyoxyalkylated amines which in 1% strength aqueous solution have a cloud point of at least 18° C and which are each derived from amines which contain at least two nitrogen atoms and at least one group which can be oxyalkylated, and in which the polyoxyalkylene chain contains a. ethylene oxide units and
b. propylene oxide, butylene oxide, cyclohexene oxide and/or styrene oxide units in the molar ratio a:b of from 10:1 to 0.1:1.

Amines of which the molecule contains at least two nitrogen atoms and at least one group which can be oxyalkylated are used as starting materials for the manufacture of the dyeing assistants to be employed according to the invention. An example of a group which can be oxyalkylated is the NH group. The dyeing assistants may also be derived from tertiary amines with at least two nitrogen atoms, provided the tertiary amine still contains at least one group which can be oxyalkylated, eg. a hydroxyl, mercapto, carboxyl and/or carboxylic acid amide group. The amines may be aliphatic, aromatic, araliphatic, cyclic or heterocyclic. It is also possible to subject a mixture of different amines to the oxyalkylation reaction. Examples of suitable amines are ethylenediamine, 2-dimethylaminoethylamine, 2-diethylaminoethylamine, 1,2-propylenediamine, 1,3-diaminopropane, 3-methylaminopropylamine, 3-dimethylaminopropylamine, 3-diethylaminopropylamine, 3-cyclohexylaminopropylamine, 1,4-diaminobutane, 4-diethylaminobutylamine, 1-diethylamino-4-aminopentane, hexamethylenediamine, 2,5-dimethylhexane-2,5-diamine, 4,9-dioxadodecane-1,12-diamine, 6,6-dimethyl-4,8-dioxaundecane-1,11-diamine, diethylenetriamine, the amide of oleic acid with diethylenetriamine, the amide of lauric acid with diethylenetriamine, dipropylenetriamine, bis-(3-aminopropyl)-methylamine, 1,2-bis-(3-aminopropylamino)-ethane, bis-(6-aminohexyl)-amine, triethylenetetramine, tripropylenetetramine, tetraethylenepentamine, tetrapropylenepentamine, polyimines, eg. polyethyleneimine, 2-aminomethylcyclopentylamine, 1,1-bis-(4-aminophenyl)-cyclohexane, 4,4'-diaminodicyclohexylmethane, 3,3'-dimethyl-4,4'-diaminodicyclohexylmethane, 2,2'-bis-(4-aminocyclohexyl)-propane, 4,4'-diaminodiphenylmethane, N,N'-dimethyl-4,4'-diaminodiphenylmethane, 3,3'-dimethyl-4,4'-diaminodiphenylmethane, tris-(2-aminoethyl)-amine, tris-(2-aminopropyl)-amine, aminoethylethanolamine, o-phenylenediamine, p-phenylenediamine, 4-aminopyridine, 2-aminopyrimidine, 1-hydroxyethyl-2-dodecylimidazoline, 1-aminoethyl-2-dodecylimidazoline, 1-hydroxyethyl-2-heptadecenyl-imidazoline, piperazine, 1-(2-hydroxyethyl)-piperazine, 1-(2-aminoethyl)-piperazine, 1,4-bis-(3-aminopropyl)-piperazine and 1-(2-aminopropyl)-piperidine.

The efficient dyeing assistants of the present invention are manufactured by oxyalkylating the relevant amines. As a rule, the procedure followed is to cause the appropriate amine to undergo addition reaction, at the group or groups which can be oxyalkylated, first with the desired amount of one alkylene oxide, then with the intended amount of the next alkylene oxide, etc. The sequence in which the oxyalkylation is carried out is not critical.

When using, eg., ethylene oxide and propylene oxide as oxyalkylating agents, the ethylene oxide and propylene oxide units may undergo addition reaction with the amine either in statistical distribution or as blocks. A statistical distribution, in the addition reaction of the alkylene oxide, is achieved by oxyalkylating the amine with a mixture of ethylene oxide and propylene oxide. In the case of block copolymers, the sequence of addition of ethylene oxide and propylene oxide may be varied. The molar ratio ethylene oxide to the other alkylene oxides may be varied within broad limits and is from 0.1:1 to 10:1, and preferably from 0.5:1 to 5:1. Each hydrogen replaceable by alkylene oxide, eg. the hydrogen of an amino group or of an OH group, can be replaced by from 1 to 100 ethylene oxide units or propylene oxide units, preferably by from 2 to 50 alkylene oxide units. Instead of propylene oxide, butylene oxides (1,2-, 2,3- or iso-butylene oxide), styrene oxide and cyclohexene oxide may also be employed, individually or together with propylene oxide.

Further very effective antimigration agents for the continuous dyeing of polyester fibers and cellulose fibers are the amine oxides which can be prepared from the polyoxyalkylated amines described above. These amine oxides are obtained by reacting the polyoxyalkylated amines with hydrogen peroxide. Depending on the degree of conversion, partially or completely oxidized polyoxyalkylated amines are obtained, and these may be employed by themselves or mixed with the oxyalkylated amines.

Quaternized polyoxyalkylated amines are also excellent antimigration agents. They are obtained, eg., from polyoxyalkylated amines by reaction with conventional quaternizing agents, eg. dimethyl sulfate. It is also possible to employ completely or partially quaternized products, or mixtures of quaternized polyoxyalkylated amines and (non-quaternized) polyoxyalkylated amines.

The dyeing assistants to be employed according to the invention are also characterized by their cloud point, which in 1% strength aqueous solution is at least 18° C. It is determined in accordance with DIN 53,917, Method 6.1 (August 1973). The cloud point is an important datum for characterizing the polyoxyalkylated amines, because the appropriate dyeing assistants cannot be adequately defined in terms of the degree of oxyalkylation, the ratio of the various alkylene oxides and other data such as hydroxyl numbers, viscosities and the like.

The dyeing assistants to be employed according to the invention are added to the aqueous liquor in amounts of from 0.5 to 70 g/l, preferably from 2 to 50 g/l. They cause the dyes to flocculate from the liquors at elevated temperatures, eg. at from 30 to 100° C. An optimum flocculation temperature for the particular dyeing process may be obtained by selecting suitable polyoxyalkylated amines, polyoxyalkylated amine oxides or quaternized polyoxyalkylated amines. It is known that padding should be carried out with dye liquors which are stable at the conventional padding temperatures (below 35° C). Flocculation is only allowed to occur at a higher temperature. In continuous dyeing, this temperature is reached, and exceeded, during the intermediate drying operation following padding with the liquor. The temperature at which flocculation occurs can be controlled both by the selection of suitable polyoxyalkylated amines, the corresponding amine oxides of polyoxyalkylated amines and the corresponding quaternized polyoxyalkylated products, and by varying the amount of these compounds and the pH of the liquor. It is particularly advantageous if the pH of the padding liquor is less than 7. Preferably, the pH is adjusted to from 3 to 6.5, although it is possible to carry out the process according to the invention at a pH above 7.

The antimigration agents according to the invention may be employed together with conventional dyeing assistants such as levelling agents and dispersing agents, with conventional antimigration agents, with non-ionic, anionic and cationic emulsifiers, with natural and synthetic protective colloids and with natural and synthetic thickeners, eg. those conventionally used in textile printing.

In the present context, polyester fibers are to be understood as linear polyester fibers, eg. polyethylene terephthalate fibers. Cellulose fibers are, eg., fibers of natural, esterified or regenerated cellulose, such as cotton, rayon staple, viscose, cuprammonium rayon, acetate and triacetate. The polyester fibers are dyed with disperse dyes, whilst the cellulose fibers are dyed with dispersed dyes, above all vat dyes, but also with naphthol dyes, sulfur dyes and some direct dyes. The method is not limited to a certain state of the fibers during processing, and can instead be employed, in principle, for dyeing tow, card, yarn, woven fabric and knitted fabric. The fibers may be texturized or non-texturized.

The process is carried out continuously by first padding, eg., a polyester fabric with the aqueous dye liquor on a padder, then subjecting the fabric to an intermediate drying operation and thereafter heating it to a higher temperature to fix the dye. In continuous dyeing of cellulose fibers, fixing means, in relation to the invention, developing the vat dye, ie. reduction, soaping and oxidation. In continuous dyeing of fabrics consisting of blends of polyester fibers and cellulose fibers, the fabric is padded with a dye liquor which contains at least one disperse dye and at least one vat dye or other dyes suitable for dyeing cellulose fibers. The liquor may also be applied to the fabric by drawing the latter through the liquor and then bringing it to a certain liquor pick-up by, eg., squeezing off. Preferably, the aqueous dye liquor containing the assistants according to the invention is applied at room temperature, but the process can also be carried out at up to 40° C, or even above. The woven or knitted fabric treated with the liquor is then heated at from 80° to 150° C, preferably from 100° to 140° C, to dry it. To fix the disperse dyes to the fibers, the fabric is heated at from 150° to 230° C, preferably from 160° to 220° C. The drying, and fixing of the disperse dyes, can also be carried out in a single step, eg. by immediately treating the fabric at 175° C, using live steam as the heating medium. When the disperse dye has been fixed, the vat dye is developed. The pH can be brought to the most advantageous range for the dyeing process by using acids or salts conventionally employed in dyeing, eg. weak acids such as acetic acid, formic acid and oxalic acid, or salts such as sodium acetate.

The dyeing assistants to be employed according to the invention prove to be very effective even with texturized polyester knitted fabrics, have no adverse effect on the stability of the liquor and hardly affect the viscosity of the latter. Because of their own good wetting action, the use of wetting agents proves superfluous with a number of the compounds according to the invention. Though addition products of ethylene oxide and/or propylene oxide with alcohols, eg. glycols, have cloud points in the range from 30° to 100° C, they nevertheless are unsuitable for use as antimigration agents in continuous processes for dyeing polyester fibers and cellulose fibers.

Experiments have shown that the oxyalkylated monoamines described in French Pat. No. 1,436,911 (eg. reaction products of 1 mole of oleylamine and 25 moles of ethylene oxide or of 1 mole of stearylamine and 25 moles of ethylene oxide) cannot be employed successfully as antimigration agents for the process described above.

The invention is explained in more detail in the Examples which follow, in which parts and percentages are by weight. The cloud point was determined by the method of DIN 53,917.

MANUFACTURE OF THE POLYOXYALKYLATED AMINES

The oxyalkylated amines are manufactured by conventional methods to which no claim is made herein.

A: Thermal Reaction Stage I 1 mole of a polyamine and 5% by weight of water, based on the polyamine, are introduced into an autoclave and reacted, at from 90 to 100° C, with one mole of propylene oxide or ethylene oxide (the epoxide being added in portions) per alkyleneamine unit or NH group, so that all reactive NH groups are converted to alkanolamine groups. It is advisable to use a 10% excess of epoxide. The reaction time, at 6 atmospheres pressure, is about 2 hours at 90° C for ethylene oxide, and about 3 hours at 100° C for propylene oxide. The reaction product is then dried at from 90° to 100° C and 15 mm Hg.

B: Catalytic Stage II 1 mole of the product manufactured according to A and 1% by weight (based on A) of 100% strength KOH are introduced into a stirred autoclave and are reacted, in accordance with the desired degree of oxyalkylation, with the appropriate amount of propylene oxide added in portions at from 130° to 135° C and/or with the requisite amount of ethylene oxide at from 120° to 125° C. The sequence is optional and it is also possible to use a gaseous mixture of ethylene oxide and propylene oxide, but in that case random copolymers are obtained. The reaction time is from 6 to 8 hours at 8 atmospheres pressure and the temperature given above for each alkylene oxide. For a gaseous mixture of ethylene oxide and propylene oxide the temperature is from 125° to 130° C. To complete the reaction, the mixture is allowed to post-react for 3 hours under pressure.

The polyoxyalkylated amines listed in Table 1 were manufactured in accordance with the process described above. The amine oxides of polyoxyalkylated amines and quaternized polyoxyalkylated amines, also shown in Table 1, were manufactured respectively by oxidation or quaternization of the corresponding polyoxyalkylated amines.

The following abbreviations were used:
EO for ethylene oxide, and
PO for propylene oxide.

The 3rd column of Table 1 shows the number of moles of ethylene oxide (EO) and propylene oxide (PO) which have undergone addition reaction per mole of amine. The first-mentioned oxide was first subjected to the addition reaction, and only afterward was the other oxide block polymerized onto the product. In the case of the polyimines, the moles of EO and PO are per ethyleneimine unit.

In the case of dyeing assistant No. 9, EO and PO were not grafted onto the amine successively, but as a gaseous mixture, and this produces a random copolymer of the two monomers, in contrast to the block copolymers $(EO)_x$-$(PO)_y$.

The penultimate column shows the cloud point, in degrees centigrade, of the particular dyeing assistant, measured in 1% strength aqueous solution.

The last column shows the molar ratio of ethylene oxide (EO) to propylene oxide (PO).

TABLE I

| Dyeing assistant No. | Amine | Type, sequence and degree of oxyalkylation | Cloud point (° C) | Molar ratio EO : PO |
|---|---|---|---|---|
| 1 | 1,6-Hexameythylenediamine | + 20 PO + 10 EO | 35 | 0.5 |
| 2 | 1,6-Hexamethylenediamine | + 24 PO + 8 EO | 28 | 0.33 |
| 3 | Ethylenediamine | + 20 PO + 5 EO | 58 | 0.25 |
| 4 | Triethylenetetramine | + 15 PO + 30 EO | 100 | 2.0 |
| 5 | Tetraethylenepentamine | + 30 EO + 30 PO | 58.5 | 1.0 |
| 6 | Tetraethylenepentamine | + 15 EO + 50 PO | 42.5 | 0.3 |
| 7 | Tetraethylenepentamine | + 50 EO + 10 PO | 100 | 5.0 |
| 8 | Tetraethylenepentamine | + 150 EO + 120 PO | 46 | 1.25 |
| 9 | Tetraethylenepentamine | + molar mixture of (30 EO + 30 PO gaseous mixture) | 63 | 1.0 |
| 10 | 4,9-Dioxadodecane-1,12-diamine | + 24 PO + 8 EO | 34.5 | 0.33 |
| 11 | 4,4'-Diamino-dicyclohexyl-methane | + 24 PO + 8 EO | 24 | 0.33 |
| 12 | 4,4'-Diamino-diphenyl-methane | + 24 PO + 8 EO | 34 | 0.33 |
| 13 | o-Phenylenediamine | + 24 PO + 8 EO | 24 | 0.33 |
| 14 | p-Phenylenediamine | + 24 PO + 8 EO | 31 | 0.33 |
| 15 | Piperazine | + 12 PO + 4 EO | 47.5 | 0.33 |
| 16 | N-Aminopropylpiperazine | + 50 PO + 20 EO | 37 | 0.4 |
| 17 | Dyeing assistant No. 3, completely quaternized with dimethyl sulfate (1 mole per mole of amine) | | 75 | 0.25 |
| 18 | Dyeing assistant No. 3, only partially quaternized with dimethyl sulfate (½ mole per mole of amine) | | 80 | 0.25 |
| 19 | Dyeing assistant No. 6, completely quaternized with dimethyl sulfate (2.5 moles per mole of amine) | | 61 | 0.3 |
| 20 | Dyeing assistant No. 24, completely quaternized with dimethyl sulfate (½ mole per ethyleneimine unit) | | 63 | 1.0 |
| 21 | Amine mixture of 1 mole each of Diethylenetriamine + Triethylenetetramine + Tetraethylenepentamine | + 34 PO + 16 EO (based on a mean molecular weight of the amine mixture) | 42.5 | 0.47 |
| 22 | Polyimine (degree of polymerization $P_n \approx 1{,}000$) | + 8 PO + 4 EO | 46 | 0.5 |
| 23 | Polyimine ($P_n \approx 1{,}000$) | + 10 EO + 20 PO | 24.5 | 0.5 |
| 24 | Polyimine ($P_n \approx 1{,}000$) | + 15 EO + 15 PO | 25 | 1.0 |
| 25 | Polyimine ($P_n \approx 500$) | + 20 EO + 20 PO | 32 | 1.0 |
| 26 | Polyimine ($P_n \approx 50$) | + 20 EO + 20 PO | 36 | 1.0 |
| 27 | Polyimine ($P_n \approx 20$) | + 20 EO + 20 PO | 69 | 1.0 |
| 28 | Mono-oxide of dyeing assistant No. 6 | | 44 | 0.3 |
| 29 | Tris-oxide of dyeing assistant No. 6 | | 45 | 0.3 |
| 30 | Penta-oxide of dyeing assistant No. 6 | | 46 | 0.3 |

Use of the compounds according to the invention

The conventional test methods used for testing the antimigration effect (H. Lehmann and F. Somm, Textil-Praxis 1973, page 52) will first be described briefly:

Plate test at 100° C

A piece of fabric (woven or knitted) of size about 12 cm × 12 cm is padded and then immediately placed on a glass plate (about 12 cm ×0 12 cm) and covered in the center only with a 1 cm thick circular glass plate (diameter about 7 cm). The assembly is then immediately placed in a drying oven at 100° C. After drying, the depth of color of the covered and uncovered areas are compared.

In this test, very great differences in depth of color between the covered and uncovered areas of the strip of woven or knitted fabric are found (a substantially lighter, circular patch being found in the covered area) even if conventional industrially used antimigration agents, such as alginates, polyacrylamides, polycarboxylic acids (including acrylic acid copolymers) or carboxymethylcelluloses are employed. Even if the said assistants are employed in very high concentrations, the test in general only shows moderate inhibition of migration.

Folding test at 100° C (cf. M. Brauer, Melliand Textilber.41(1960)1102)

The strip of woven or knitted fabric of size about 12 × 12 cm, which has been padded with the dye liquor, is folded once, closed air-tight at the 3 open ends with broad metal clips and hung in a drying oven at 100° C. As a result of the strip having been folded, drying is only possible on the outer face of the fabric. The dye inside the fabric strip will attempt to migrate through the fabric. Accordingly, distinct differences in depth of color are found between the inner face and outer face.

Comparison of inside and outside of a texturized polyester material

A strip of polyester knitted fabric (Diolen loft knitted fabric, Trevira 2,000 knitted fabric etc.) of size about 40 cm × 12 cm is padded, dried for 120 seconds on a pin stenter at 110° C and then thermosoled for 90 seconds at 165° C. After reductive cleaning for 30 minutes at 70° C in a liquor comprising 4 g/l of sodium hydroxide solution of 38° Be strength, 2 g/l of concentrated hydrosulfite powder and 1 g/l of oleylamine polyglycol ether, using a liquor ratio of 40:1, the evenness and depth of color, the dye migration at the edges and perforation points of the pins, and the difference in depth of color between the inside and the outside of the texturized polyester knitted fabric is assessed; an assessment of the latter difference is very easily possible by stretching the knitted fabric. The objective is that with the fabric stretched, the obviousness of lighter-colored strips should be minimized.

EXAMPLE 1

A texturized polyester material (Diolen loft knitted fabric) is padded at room temperature with a liquor, which contains, per liter of water, 25 g of the yellow disperse dye C.I. No. 47,023, in its commercial form and consistency, and 10 g of the dyeing assistant No. 2, and which has been brought to pH 4.5 with acetic acid; the liquor pick-up is about 80% (based on dry goods weight).

The plate test is carried out with a part of the padded fabric, at 100° C. The test shows only very slight dye migration, in contrast to experiments with conventional antimigration agents, eg. a medium-viscosity sodium alginate or a copolymer of acrylic acid, having a Ford cup 8 flow time of 100 seconds. With a compound of 1 mole of oleylamine and 25 moles of ethylene oxide, again virtually no migration-inhibiting effect is found.

Another part of the padded fabric is intermediately dried on a pin stenter at 110° C for 120 seconds, then subjected to a thermosol treatment at 165° C for 90 seconds and cleaned reductively in the conventional manner. A level deep dyeing with good general fastness properties is obtained. On pulling the knitted fabric apart, lighter-colored stripes do not become visible. Extremely little dye migration is found at the points of perforation of the pins. The antimigration effect of the assistant used by far surpasses that of conventional migration inhibitors.

Similar results are obtained if Diolen loft knitted fabric is dyed with the dyes and assistants shown in Table II, under the conditions also shown in the Table:

TABLE II

| Example No. | Liquor composition and operating conditions: Nature and amount of dye | | Dyeing assistant: Amount | Dyeing assistant: No. | pH value | Liquor pick-up |
|---|---|---|---|---|---|---|
| 1 a | 50 g/l | of the pink disperse dye from German Patent 1,209,680, Example 2/1 | 10 g/l | 10 | 5 | 80% |
| 1 b | 10 g/l | " | 6 g/l | 10 | 5 | 80% |
| 1 c | 30 g/l | " | 8 g/l | 7 | 4.5 | 80% |
| 1 d | 50 g/l | " | 30 g/l | 7 | 4.5 | 100% |
| 1 e | 50 g/l | " | 12 g/l | 25 | 4.5 | 80% |
| 1 f | 50 g/l | " | 12 g/l | 25 | 6.0 | 80% |
| 1 g | 40 g/l | of the blue disperse dye from German Patent 1,176,777, Example 10 | 9 g/l | 12 | 4.5 | 80% |
| 1 h | 40 g/l | " | 15 g/l | 1 | 4.5 | 80% |
| 1 i | 40 g/l | " | 10 g/l | 6 | 4.5 | 80% |
| 1 j | 40 g/l | " | 10 g/l | 19 | 4.5 | 80% |
| 1 k | 25 g/l | " | 7 g/l | 21 | 4.5 | 80% |
| 1 l | 25 g/l | " | 10 g/l | 14 | 4.5 | 80% |
| 1 m | 5 g/l | " | 5 g/l | 23 | 4.5 | 80% |
| 1 n | 10 g/l | " | 5 g/l | 8 | 4.5 | 80% |
| 1 o | 50 g/l | of the red disperse dye from German Patent 1,271,284, Example 4, column 9, 1st line | 10 g/l | 24 | 5 | 80% |
| 1 p | 50 g/l | " | 20 g/l | 22 | 6.5 | 80% |
| 1 q | 10 g/l | " | 6 g/l | 3 | 4.5 | 80% |
| 1 r | 10 g/l | " | 6 g/l | 18 | 4.5 | 80% |
| 1 s | 10 g/l | " | 6 g/l | 17 | 4.5 | 80% |
| 1 t | 50 g/l | " | 15 g/l | 27 | 4.5 | 80% |
| 1 u | 50 g/l | " | 10 g/l | 9 | 4.5 | 80% |
| 1 v | 30 g/l | " | 12 g/l | 16 | 4.5 | 80% |
| 1 w | 30 g/l | " | 12 g/l | 16 | 4.5 | 100% |
| 1 x | 3 g/l | " | 3 g/l | 11 | 4.5 | 80% |
| 1 y | 10 g/l | " | 15 g/l | 26 | 4.5 | 80% |

EXAMPLE 2

A texturized polyester material (Trevira 2000 knitted fabric) is padded at room temperature with a liquor which contains, per liter of water, 50 g of the red disperse dye from German Patent No. 1,271,284, Example 4, column 9, 1st line, in its commercial form and consistency, and 13 g of the dyeing assistant No. 4, and which has been brought to pH 4.5 with acetic acid; the fabric is squeezed off to a liquor pick-up of about 80%.

The plate test at 100° C is carried out with a part of the strip of knitted fabric, and the folding test at 100° C with another part of the fabric. Both test methods show only negligible dye migration, which in the plate test manifests itself in the circular patch of the covered area being barely discernible and in the folding test in that there are virtually no differences in depth of color between the inside and outside. If the conventional antimigration agents, eg. a carboxymethylcellulose which in 30% strength aqueous solution has a Ford cup 8 flow time of 58 seconds, or an acrylic acid copolymer which has a Ford cup 8 flow time of 100 seconds, are used, the success, as measured by the above test methods, in suppressing dye migration is only very moderate.

Dye migration can also not be prevented by using a compound of 1 mole of oleylamine and 25 moles of ethylene oxide or a compound of 1 mole of dodecylamine, 5 moles of propylene oxide and 20 moles of ethylene oxide (according to French Patent No. 1,436,911).

Similar results are obtained if Trevira 2,000 knitted fabric is dyed with the dyes and assistants shown in Table III, under the conditions also shown in the Table.

TABLE III

| Example No. | Liquor composition and operating conditions: Nature and amount of dye | | Dyeing assistant: Amount | Dyeing assistant: No. | pH value | Liquor pick-up |
|---|---|---|---|---|---|---|
| 2 a | 50 g/l | of the blue disperse dye from German Patent 1,176,777, Example 10 | 10 g/l | 5 | 5 | 80% |
| 2 b | 30 g/l | " | 9 g/l | 15 | 4.5 | 80% |
| 2 c | 10 g/l | " | 6 g/l | 28 | 4.5 | 80% |
| 2 d | 10 g/l | " | 6 g/l | 30 | 4.5 | 80% |
| 2 e | 30 g/l | " | 12 g/l | 27 | 5 | 80% |
| 2 f | 40 g/l | of the blue disperse dye from German Patent 1,228,585, Example 1 | 8 g/l | 2 | 4.5 | 80% |
| 2 g | 40 g/l | " | 8 g/l | 2 | 4.5 | 100% |
| 2 h | 20 g/l | " | 7 g/l | 6 | 4.5 | 80% |
| 2 i | 20 g/l | " | 7 g/l | 29 | 4.5 | 80% |
| 2 j | 50 g/l | of the yellow disperse dye C.I. No. 47,023 | 20 g/l | 3 | 5 | 80% |
| 2 k | 50 g/l | " | 8 g/l | 4 | 4.5 | 80% |
| 2 l | 50 g/l | " | 8 g/l | 5 | 4.5 | 80% |
| 2 m | 50 g/l | " | 8 g/l | 9 | 4.5 | 80% |
| 2 n | 50 g/l | " | 5 g/l | 24 | 3.5 | 80% |
| 2 o | 50 g/l | " | 5 g/l | 20 | 3.5 | 80% |

EXAMPLE 3

The same dye liquors as in Examples 2 are used for padding non-texturized polyester woven fabric, but the liquor pick-up is about 60%, based on the fabric. With this fabric, again, both the plate test and the folding test shows at most an extremely slight dye migration, in the case of all the assistants employed.

EXAMPLE 4

A blended woven fabric of polyester fibers and cotton fibers mixed in the proportions of 67:33 is padded at room temperature with a liquor which contains, per liter of water, 25 g of the vat dye C.I. No. 67,000, 10 g of the pink disperse dye from German Patent No. 1,209,680, Example 2/1, 4 g of the red disperse dye from German Patent No. 1,259,285, Example 2 and 2 g of the red disperse dye from German Patent No. 1,271,284, Example 4, column 9, 1st line, in their commercial form and consistency, and 10 g of the dyeing assistant No. 10 (from Table I), and which has been brought to pH 4.5 with acetic acid; the liquor pick-up is about 60% (based on dry goods).

The plate test at 100° C and/or the folding test at 100° C are carried out with a part of the padded strip of fabric. The other part of the blended fabric is dried for 60 seconds at 110° C, then treated with hot air at 210° C for 60 seconds, and thereafter developed, in the laboratory, in a continuously rotating apparatus working on the Launder-O-Meter principle, for 30 minutes at 60° C using a chemical liquor (liquor ratio 1:5) which contains, per liter of water, 20 ccs of sodium hydroxide solution of 38° Be strength, 8 g of concentrated hydrosulfite powder and 3 g of a dispersing agent based on the sodium salt of a $\beta$-naphthalenesulfonic acid/formaldehyde condensation product.

After soaping at the boil in the conventional manner for 20 minutes, the polyester and cotton constituents of the fabric are dyed red in approximately matching shades.

In both the plate test and the folding test virtually no dye migration is found. The effect is clearly superior to that of conventional antimigration agents, such as an acrylic acid copolymer having a Ford cup 8 flow time of 100 seconds.

The finished dyeings are deep and level; their general fastness properties are good.

Similar results are obtained if the dye mixtures shown in Table IV, in their commercial form and consistency, and the assistants also shown in Table IV are employed:

TABLE IV:

| Example No. | Liquor composition and operating conditions: Nature and amount of dye | Dyeing assistant Amount | Dyeing assistant No. | pH value | Liquor pick-up |
|---|---|---|---|---|---|
| 4 a | Dye mixture and amount as in Example 4 (red) | 5 g/l | 24 | 4.5 | 60% |
| 4 b | " | 15 g/l | 22 | 5 | 60% |
| 4 c | " | 7 g/l | 29 | 4.5 | 60% |
| 4 d | " | 3 g/l | 6 | 4.0 | 60% |
| 4 e | A mixture of: 15 g/l of the green vat dye C.I. 59,825 30 g/l of the blue disperse dye from German Patent 1,176,777, Example 10 5 g/l of the yellow disperse dye C.I. 47,023 (final color: green) | 8 g/l | 2 | 4.5 | 60% |
| 4 f | " | 8 g/l | 2 | 4.5 | 80% |
| 4 g | " | 10 g/l | 12 | 5.0 | 60% |
| 4 h | " | 7 g/l | 27 | 4.5 | 60% |
| 4 i | A mixture of: 20 g/l of vat dye C.I. 60,005 30 g/l of disperse dye C.I. 62,030 (final color: violet) | 6 g/l | 4 | 4.5 | 60% |
| 4 j | " | 11 g/l | 8 | 4.5 | 60% |
| 4 k | " | 9 g/l | 9 | 4.5 | 60% |
| 4 l | " | 10 g/l | 19 | 4.5 | 60% |
| 4 m | " | 10 g/l | 19 | 8.0 | 60% |
| 4 n | A mixture of: 33 g/l of vat dye C.I. 67,820 2 g/l of the disperse dye from German Patent 1,209,680, Example 2/1 15 g/l of the disperse dye of the formula 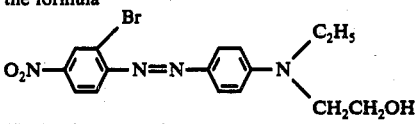 (final color: orange) | 10 g/l | 21 | 5.0 | 60% |
| 4 o | A mixture of: 33 g/l of vat dye C.I. 67,820 2 g/l of the disperse dye from German Patent 1,209,680, Example 2/1 15 g/l of the disperse dye of the formula 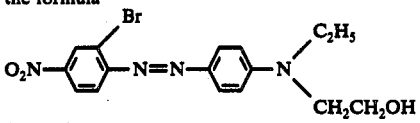 (orange) | 6 g/l | 15 | 4.5 | 60% |
| 4 p | " | 8 g/l | 25 | 4.5 | 60% |
| 4 q | " | 8 g/l | 25 | 6.0 | 60% |
| 4 r | " | 8 g/l | 25 | 4.5 | 75% |
| 4 s | " | 8 g/l | 25 | 4.5 | 50% |

EXAMPLE 5

A cotton woven fabric is padded at room temperature with a liquor which contains, per liter of water, 40 g of the red vat dye C.I. 67,000 in its commercial form and consistency and 8 g of dyeing assistant No. 3, and which has been brought to pH 4.5 with acetic acid; the fabric is squeezed off to a liquor pick-up of 60% based on dry goods weight.

After padding, a part of the fabric is subjected to the plate test at 100° C. The other piece of fabric is intermediately dried for 60 seconds at 110° C and then developed in the laboratory in a continuously rotating apparatus, working on the Launder-O-Meter principle at 60° C for 45 minutes, using a chemical liquor (liquor ratio 4:1) which contains, per liter of water, 18 ccs of sodium hydroxide solution of 38° Be strength and 5 g of concentrated hydrosulfite powder, and is then soaped at the boil. A smooth deep red dyeing of good evenness is obtained. The plate test shows virtually no dye migration, in contrast to the result obtained with liquors containing the conventional antimigration agents, eg. a medium-viscosity sodium alginate or an acrylic acid copolymer having a Ford cup 8 flow time of 100 seconds.

Similar results are obtained if the dyes and assistants shown in Table V are employed:

TABLE V

| Example No. | Liquor composition and operating conditions: Nature and amount of dye | Dyeing assistant Amount | Dyeing assistant No. | pH value | Liquor pick-up |
|---|---|---|---|---|---|
| 5 a | 40 g/l of the red vat dye C.I. 67,000 | 7 g/l | 11 | 4.5 | 60% |
| 5 b | " | 12 g/l | 8 | 4.5 | 60% |
| 5 c | " | 5 g/l | 6 | 4.5 | 60% |
| 5 d | 30 g/l of the green vat dye | 6 g/l | 6 | 4.5 | 60% |

TABLE V-continued

| Example No. | Liquor composition and operating conditions: Nature and amount of dye | Dyeing assistant: Amount | Dyeing assistant: No. | pH value | Liquor pick-up |
|---|---|---|---|---|---|
| | C.I. 59,825 | | | | |
| 5 e | " | 9 g/l | 3 | 4.5 | 60% |
| 5 f | " | 9 g/l | 17 | 4.5 | 60% |
| 5 g | 50 g/l of the black vat dye | 8 g/l | 20 | 4.5 | 60% |
| | C.I. 65,230 | | | | |
| 5 h | " | 8 g/l | 20 | 8.5 | 60% |
| 5 i | " | 15 g/l | 27 | 4.5 | 60% |
| 5 j | 40 g/l of the orange vat dye | 10 g/l | 5 | 4.5 | 60% |
| | C.I. 67,820 | | | | |
| 5 k | " | 10 g/l | 5 | 4.5 | 50% |
| 5 l | " | 10 g/l | 5 | 4.5 | 70% |
| 5 m | " | 10 g/l | 9 | 4.5 | 60% |
| 5 n | " | 10 g/l | 28 | 4.5 | 60% |
| 5 o | " | 10 g/l | 30 | 5.5 | 60% |

We claim:

1. A process for the continuous dyeing of polyester fibers, cellulose fibers or blends of these fibers, which process comprises:

continuously applying to said fibers an aqueous dye liquor which contains

I. a disperse dye for polyester fibers, and for cellulose fibers a dye selected from the group consisting of vat dyes, naphthol dyes, sulfur dyes and direct dyes, and II. from 0.5 to 70 g/l of said aqueous dye liquor of an antimigration agent selected from the group consisting of polyoxyalkylated amines, amine oxides of polyoxyalkylated amines and quaternized polyoxyalkylated amines which in 1% strength aqueous solution have a cloud point of at least 18° C and which are each derived from amines which contain at least 2 nitrogen atoms and at least one group which can be oxyalkylated and in which the polyoxyalkylene chain contains a. ethylene oxide units and b. a second component selected from the group consisting of propylene oxide, butylene oxide, cyclohexene oxide and styrene oxide units in the molar ratio a:b of from 10:1 to 0.1:1, said continuous application being carried out at a temperature below that at which the dye or dyes flocculate from the liquor;

drying the fibers while heating at an elevated temperature sufficient to flocculate the dye or dyes from the liquor; and fixing the dye or dyes to said fibers.

2. A process as claimed in claim 1, in which from 2 to 50 g/l of aqueous dye liquor of the antimigration agent are employed.

3. A process as claimed in claim 1, in which the polyoxyalkylated amine, amine oxide or quaternized amine is derived from 1,6-hexamethylenediamine, ethylenediamine, triethylenetetramine, orthophenylenediamine or polyethyleneimine.

4. A process as claimed in claim 3, in which the antimigration agent employed is a polyethyleneimine which is first oxyalkylated with ethylene oxide and then with propylene oxide, and is finally quaternized.

5. A process as claimed in claim 1, in which the pH of the dye liquor is from 3 to 6.5.

6. A process as claimed in claim 1, in which the continuous dye application is carried out at about room temperature up to about 40° C. and the dye flocculation is carried out at a drying temperature of from about 80° to 150° C.

7. A process as claimed in claim 6, in which the pH of the dye liquor is from 3 to 6.5.

* * * * *